United States Patent [19]

Weidenaar

[11] 4,105,054

[45] Aug. 8, 1978

[54] VAPOR SEALING MEANS FOR FUEL DISPENSING NOZZLES

[75] Inventor: Bernard E. Weidenaar, Harvey, Ill.

[73] Assignee: Atlantic Richfield Company, Philadelphia, Pa.

[21] Appl. No.: 767,709

[22] Filed: Feb. 11, 1977

Related U.S. Application Data

[63] Continuation of Ser. No. 599,452, Jul. 28, 1975, abandoned, which is a continuation of Ser. No. 473,454, May 28, 1974, abandoned.

[51] Int. Cl.[2] ..... B65B 3/18

[52] U.S. Cl. ..... 141/311 R; 141/392; 141/DIG. 1

[58] Field of Search ..... 141/39-44, 141/52, 59, 97, 290, 310, 311, 382-384, 387, 388, 390, 392, DIG. 1; 285/9, 9 M, 263, 272; 335/285, 303

[56] References Cited

U.S. PATENT DOCUMENTS

| | | | |
|---|---|---|---|
| 3,257,586 | 6/1966 | Steingrover | 335/303 |
| 3,566,928 | 3/1971 | Hansel | 141/97 |
| 3,840,055 | 10/1974 | Wostl et al. | 141/392 X |

*Primary Examiner*—Richard E. Aegerter
*Assistant Examiner*—Frederick R. Schmidt
*Attorney, Agent, or Firm*—John B. Goodman

[57] ABSTRACT

An improved fuel vapor recovery means surrounding the spout of a fuel-dispensing nozzle is sealed to the fillpipe of, e.g., an automobile fuel tank, by means of a highly anisotropic or mono-directional magnet disposed on the forward portion of the vapor recovery means. Fuel vapor escaping from the fuel tank during the filling operation is thus minimized and the magnet provides sufficient directional force to provide additional support for the entire nozzle. The magnet is preferably of the ceramic type and is magnetically oriented such that it exhibits a strong magnetic force axially of the spout, thereby sealing the vapor collector to the fillpipe, and may be backed by a steel plate to direct and enhance the magnetic forces issuing from the front of the ceramic magnet.

18 Claims, 3 Drawing Figures

VAPOR SEALING MEANS FOR FUEL DISPENSING NOZZLES

This is a continuation, of application Ser. No. 599,452, filed July 28, 1975 now abandoned, which in turn is a continuation of Application Ser. No. 473,454, filed May 28, 1974, now abandoned.

The present invention relates to a nozzle for dispensing liquid and more particularly to a nozzle assembly having a highly mono-directional magnet for improving the sealing of the vapor recovery means which surrounds the spout of the nozzle to the fillpipe of an automobile fuel tank, thereby minimizing escape of vapors from the fuel tank to the atmosphere during the filling operation.

During the dispensing of liquid fuel, such as gasoline, from a storage tank into the fuel tank of, for example, a motor vehicle, the liquid hydrocarbon fuel displaces vapors from the tank in approximately equal volume to the amount of liquid fuel introduced into the fuel tank. The displaced vapors contain hydrocarbons, and thus if the vapors are allowed to escape into the atmosphere, the hydrocarbons contained therein would further contribute to the air pollution problem. In addition, these vapors, containing hydrocarbons which are combustible, also present a potential fire hazard to the individual supervising the filling operation.

The prior art suggests several mechanisms for providing a vapor seal between the spout of the fuel dispensing nozzle and the fillpipe of the fuel tank, in order to collect and remove vapors displaced from the tank by the entering fuel, and either to dispose of them or treat them with, for example, a combustion means to render them harmless. For example, U.S. Pat. No. 3,581,782 discloses a vapor emission control system suitable for gasoline and other fuel delivery systems adapted to reduce the escape of fuel vapors to the atmosphere. The disclosed embodiment of the control system includes, for example, a flexible annular sleeve surrounding the spout and forming a seal with the fillpipe of the fuel tank by means of an expandable member which, when expanded after the spout is placed in the fillpipe, reduces the emission of vapor to the atmosphere.

Similarly, U.S. Pat. No. 3,566,928 discloses a vapor seal for fuel dispensing nozzles wherein the forward end (i.e., the end opposite the main housing of the nozzle) of the flexible bellows which surrounds the spout forms a seal with the fillpipe of the fuel tank by means of an annular-shaped magnetic rubber sealing assembly comprised of three separate elements secured together in a concentric arrangement. The three separate elements comprise an inner pole piece of low-carbon steel, an intermediate element of magnetic rubber and an outer pole piece of low-carbon steel. The intermediate magnetic rubber element contacts the fillpipe of the fuel tank thereby providing a seal between the flexible bellows and the fillpipe, while the entire magnet tends to maintain the seal due to the magnetic attraction with the metallic fillpipe.

There is, therefore, a need for sealing means which provide a reliable seal for minimizing the loss of vapors during the dispensing of fuel and which is particularly adaptable for unattended service station operations wherein the dispensing nozzle is not supported by hand. In addition, there is a need for vapor recovery means which are simple in design and of a weight which is suitable for service station operations including self-service station operations.

It is, therefore, a primary object of the present invention to provide an improved sealing means between the vapor recovery means surrounding the spout of a fuel dispensing nozzle and the upper end of the fillpipe of the fuel tank.

It is a further object of the present invention to provide such an improved sealing means which is extremely reliable and which additionally provides an extremely strong seal.

It is yet another object of the present invention to provide an improved sealing means which assists in the support of the fuel dispensing nozzle during the filling operation. Such support and reliability would be required, for example, during the self-service dispensing of gasoline.

Other objects and advantages will become apparent from the ensuing description.

The present invention accomplishes the above and other objects by utilizing a mono-directional magnet sealing means affixed to vapor recovery means which surrounds the spout of the fuel dispensing nozzle. The sealing means contacts the upper end of the fillpipe of the fuel tank, in the sense of exhibiting a magnetic force against the fillpipe. The mono-directional magnet means is typically a ceramic-type magnet composed of, e.g., hard ferrite magnetically oriented in one direction. Such a ceramic mono-directional magnet exerts a very strong magnetic field in an axial direction to firmly seal the forward end of the vapor recovery means which surrounds the spout of the nozzle to the fillpipe, and in addition, provides a sufficient directional force in order to provide additional support to the nozzle during the filling operation. If desired, the forward end of the mono-directional magnet sealing means may be covered with a compressible material which aids in the sealing operation, such as a leather, foam or plastic material, and which is substantially resistant to the fuel being dispensed.

Figure 1:
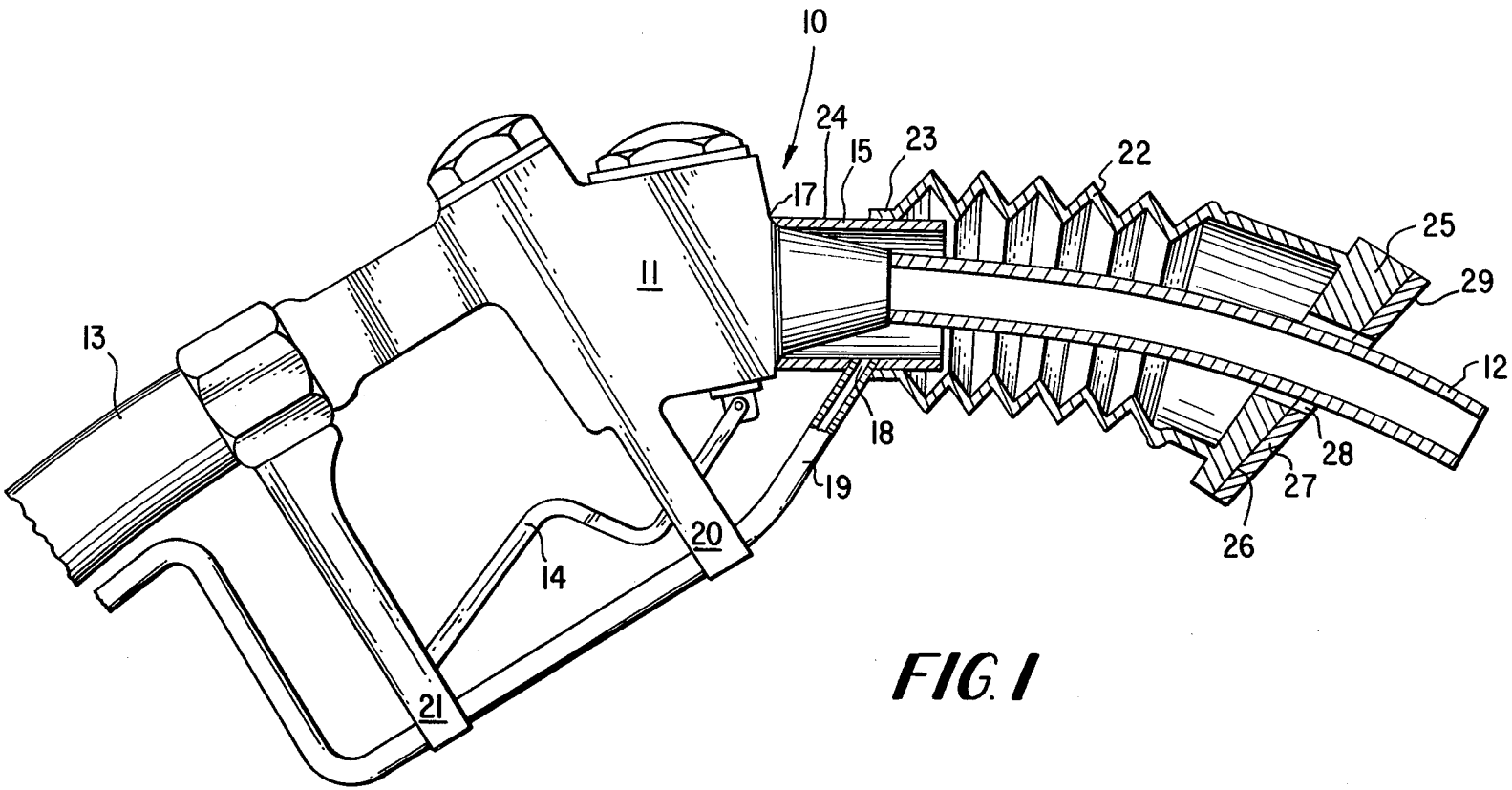
FIGS. 1 and 2 show alternative embodiments of the present invention and illustrate two different techniques for removing vapors which are displaced from the fuel tank being filled.

The improved vapor recovery apparatus of the present invention is useful in dispensing any liquid where escape of vapors during the dispensing operation is a potential problem, but is particularly useful when gasoline — or other liquid fuel — is employed in the fueling of vehicle fuel tanks. Therefore, for purposes of ease of description only, the following description will be limited to the latter environment, although those skilled in the art will realize the broader aspects of the invention.

A liquid fuel-dispensing nozzle comprises a housing, a discharge spout and normally, conduit means connected to the housing for supplying fuel to the housing. Control means is usually provided integral with the nozzle housing for actuating the nozzle for the delivery of fuel. Further, as is conventional in the art, retainer means are also normally provided for maintaining the control means open in a fuel-dispensing position during unattended operations. The retainer means is usually associated with automatic shut-off means adapted for automatically stopping fuel delivery when the fuel tank is substantially full. As such nozzles are well-known in the art, no attempt will be made here to describe the same in detail.

In order to prevent escape of fuel vapors from the fuel tank fillpipe during the fuel dispensing operation, the prior art suggests that vapor recovery means such as a vapor collector be disposed in spaced relation around a portion of the discharge spout and sealed to the nozzle housing at one end thereof. By sealing the opposite end of the vapor collector to the fillpipe, escaping vapors from the fillpipe enter the vapor collector rather than the atmosphere. The vapor collector can typically comprise a resilient bellows which forms a seal at its forward end (i.e., the end opposite the housing of the nozzle) with the fillpipe.

The improvement embodied in the present invention is in the use of a particular type of magnet sealing means carried by or affixed to the forward end (or "heal" portion) of the vapor recovery means. The magnet sealing means of the present invention exerts a strong magnetic force in substantially one direction; i.e., in an axial direction to the nozzle discharge spout when the magnet sealing means surrounds the spout carried by or secured to the forward end of the vapor recovery means. This strong, highly-mono-directional magnetic force enables an extremely good vapor seal to be obtained and, at the same time, provides additional support for the entire nozzle assembly when the latter is inserted into a fillpipe for delivery of fuel. In order to provide the best vapor seal, the front face of the unidirectional magnet sealing means (which would normally contact the fillpipe) may be covered with a resilient material such as leather, a compressible cellular plastic, plastic and cloth, or a combination of two or more of such materials. Of course, the resilient material, as well as the material constituting the vapor collector, must be resistant to the liquid fuel and its vapors. It is in a particularly preferred embodiment of this invention, the unidirectional magnet is coated with a compressible cellular plastic material which has a face of either a synthetic plastic material or of leather. The term "magnet sealing means" which provides a seal at the fillpipe is used herein to include the unidirectional magnet optionally coated with one or more resilient materials.

The resilient material may be secured to the unidirectional magnet by any suitable means, for example, an epoxy-type cement can be employed for this purpose, but those skilled in the art will realize that any adhesive means may be employed for this purpose. Of course, the resilient material must be formed of a material which is substantially resistant to the fuel liquid and vapor being dispensed. The term "resilient" is used in its normal dictionary sense and includes materials which deform to a certain extent when the spout of the nozzle is inserted into the fillpipe, thereby providing an extremely good seal against vapor escape. Typically, examples of the compressible cellular plastic materials are the cellular material (i.e., foams) obtained from polychloroprene latex, polyethylene, silicone, urethane polymer, poly(vinyl chloride), polytetrafluoroethylene, cellulose acetopropianate, and urea-formaldehyde resin. Particularly preferred compressible cellular plastic materials are polyurethane foam and polychloroprene latex foam.

It is particularly preferred that the compressible cellular plastic material have affixed thereto an additional resilient material, such as leather or plastic. As an example, the exposed face of the compressible cellular plastic material can be coated with the same plastic material used to form the cellular plastic material. Thus, the face can have a surface skin or coating which contacts the receiver inlet to which liquid is being dispensed. In addition, the face of the compressible cellular plastic material can have a surface skin or coating which is of a different material such as a synthetic resinous material or a natural occurring material, both of which are substantially resistant to the fuel liquid and vapor being dispensed. The coating material, either the same or different from the compressible cellular plastic material, has to be resilient, that is, the material deforms to a certain extent when the spout of the nozzle is inserted into the fuel pipe. Typical examples of a combination of resilient materials are leather and/or synthetic resin such as polychloroprene (neoprene) in combination with compressible cellular plastic material. It is contemplated within the scope of this invention that the term "resilient material" includes such coating or different resilient materials affixed to the unidirectional magnet to form the exposed face seal.

The thickness of the resilient material is not critical, and may vary from a minimum thickness required to provide the minimum seal to a maximum thickness which would be dictated by economic considerations (i.e., an extremely thick material would not be required). Typically the resilient material is utilized in a thickness which may range from about 1/16 inch to about ½ inch.

FIG. 1 shows a preferred embodiment of the nozzle assembly and vapor recovery means of the present invention. A fuel-dispensing nozzle is generally designated 10 and comprises a body or housing 11 from which extends a discharge spout 12 for dispensing the fuel into the fuel tank. A conduit 13 supplies fuel to the nozzle from a suitable storage facility. A handle 14 is provided for actuating the nozzle and, as is conventional, a retaining means may be provided on the main body of the nozzle for holding the handle 14 in its fuel-delivery position, as is standard in the art. The retainer is not shown in FIG. 1.

The front tapered portion 16 of the main nozzle body is surrounded by a sleeve 15 which is secured to the nozzle body by means of, for example, a weld, at 17. Sleeve 15 is provided with an aperture 18 at a suitable location, the purpose of which will be explained below.

A flexible means such as a bellows 22 is provided around spout 12, and the upper end 23 of bellows 22 tightly engages the outside surface 24 of sleeve 15, thereby preventing escape of vapors at this point.

The forward portion of bellows 22, i.e., heel portion 25, has an annular-shaped mono-directional magnet 27 secured thereto at face 26. Any conventional adhesive may be employed to secure mono-directional magnet 27 to face 26 of heel portion 25, such as epoxy cement.

It is preferred that the outer face 29 of mono-directional magnet 27 may be covered with a resilient material, such as leather, foam, or synthetic plastic material as described above to provide an improved seal between the mono-directional magnet and the upper end of the fillpipe.

An internal conduit 28 is formed between the inside of the substantially annular-shaped heel portion 25 and magnet 27 and spout 12 which permits vapors displaced from the fillpipe to pass therethrough and enter the interior of bellows 22. A further conduit means 19 is attached to sleeve 15 at aperture 18, conduit means 19 being supported by extensions 20 and 21 from the main body of the fuel-dispensing nozzle.

In operation, the forward end of spout 12 is inserted into the fillpipe (not shown) of, for example, an automobile fuel tank. A spring means (not shown), round or square, preferably square, may surround the major portion of spout 12, as is conventional, for assisting in holding the spout in the fillpipe during the filling operation. As the spout 12 is inserted into the fillpipe, the forward face 29 of mono-directional magnet 27 contacts the upper portion of the fillpipe and the flexible bellows 22 is compressed toward the main body 11 of the nozzle. Since the compressed bellows 22 has a tendency to reexpand toward the fillpipe, and since the mono-directional magnet 27 exerts a highly mono-directional force toward the metal fillpipe, the nozzle is strongly retained in this position and an extremely tight seal is provided between the forward face 29 of magnet 27 and the upper portion of the fillpipe.

After the handle 14 is lifted into its fuel-delivery position, the fuel flows through conduit 13, through the main body of nozzle 11 and through spout 12 into the fillpipe. The fuel displaces vapors contained in the fuel tank in approximately equal volume and the vapors are thereby forced out of the fuel tank through the fillpipe. These vapors pass through internal conduit 28 and into the interior of bellows 22 from which they exit through aperture 18 in sleeve 15, then through conduit 19 for disposal and/or treatment by suitable means such as by absorbtion or condensation.

The improved vapor recovery means of the present invention depends for its efficacy upon the use of a specific magnet, i.e., a highly mono-directional magnet which exerts a very strong magnetic force thereby firmly forming a seal with the fillpipe against vapor loss. The mono-directional magnet must provide sufficient directional force in order to provide additional support to the nozzle especially during unattended operations. The preferred mono-directional magnet is a highly anisotropic ceramic magnet formed of a hard ferrite material (e.g., barium-iron oxide and/or strontium-iron oxide). The term "anisotropic" is defined as a material having a preferred magnetic orientation such that its magnetic characteristics are better along one axis than along any other axis. The material selected for the mono-directional magnet may be a hard ferrite material utilized in ceramic magnets. For example, a typical base formation may comprise $Fe_2O_3$ and $BaCO_3$ in sufficient quantity to form, upon calcining and firing, $BaO.6Fe_2O_3$, a known permanent magnet ferrite base material. A typical specific mixture is 6 moles of $Fe_2O_3$ and 1.13 moles of $BaCO_3$ (calculated as the oxide BaO). Reference is here made to U.S. Pat. Nos. 3,136,033; 3,549,315; 3,114,715; 2,828,264; 3,602,986; 3,625,898; 3,694,360; 3,530,551; and 3,236,928 for a detailed description of how the magnet may be formed and oriented. The disclosures of said patents are expressly incorporated herein by reference.

The mono-directional magnet used in the present invention is magnetically oriented in such a direction that it exerts strong magnetic characteristics in a direction axially of the discharge spout of the nozzle to thereby provide an improved vapor seal and to assist in supporting the nozzle during the delivery of liquid. Typical examples of such unidirectional magnets are ones having a residual induction of about 3850 gauss and an intrinsic coercive force greater than 3000 oersteds, ceramic unidirectional magnets ($BaO.6Fe_2O_3$) having residual inductions of about 3600 gauss and 3950 gauss, respectively, and intrinsic coercive force greater than 3100 oersteds and 2470 oersteds, respectively.

The monodirectional magnet is preferably disposed on a metal backing plate and the latter secured to the bellows, since the magnetic force from the mono-directional magnet is significantly increased thereby, often up to a 30% increase. The metal backing plate of the magnet is similar in thickness to the thickness of the magnet. The thickness of this metal plate can vary as long as it is sufficiently thick to provide resistance to cracking or chipping of the magnet and maximizes the magnetic force issuing from the front of the unidirectional magnet.

Figure 2:
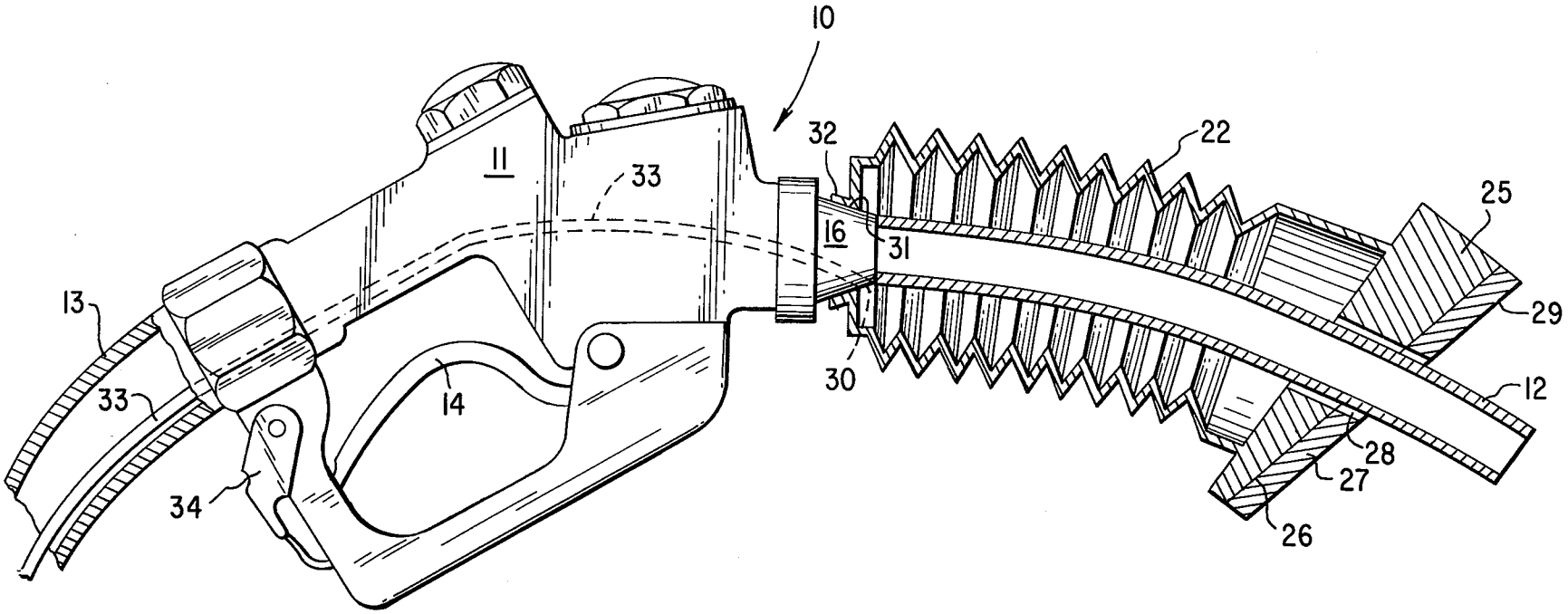

Referring now to FIG. 2, an alternative embodiment of the present invention is illustrated, with the same reference numerals indicating identical parts. Note that in FIG. 2, a retainer (designated 34) is shown for holding the handle 14 in its fuel-delivery position, as is conventional in the art. The manner of removing the vapors from the interior of the bellows 22 in FIG. 2 differs somewhat from that shown in FIG. 1. Specifically, the upper end 32 of bellows 22 is tightly sealed against surface 31 of the tapered portion 16 of nozzle 11. An aperture 30 is provided in this tapered portion 16 and a conduit means 33 is provided for removing the vapor from the interior of bellows 22 for treatment and/or disposal.

The specific embodiments for removing the vapor shown in FIGS. 1 and 2 are merely exemplary, as those skilled in the art will realize. Any means may be utilized for removing vapor from the vicinity of the spout of the nozzle for treatment and/or disposal. For example, the upper portion of the bellows may be provided with an exit hole to which a flexible tubing may be connected for removing the vapor, and as an example, this flexible tubing may be supported by the main conduit 13 for transporting the vapor away from the vicinity of the nozzle. Any other suitable arrangement may be utilized.

Figure 3:
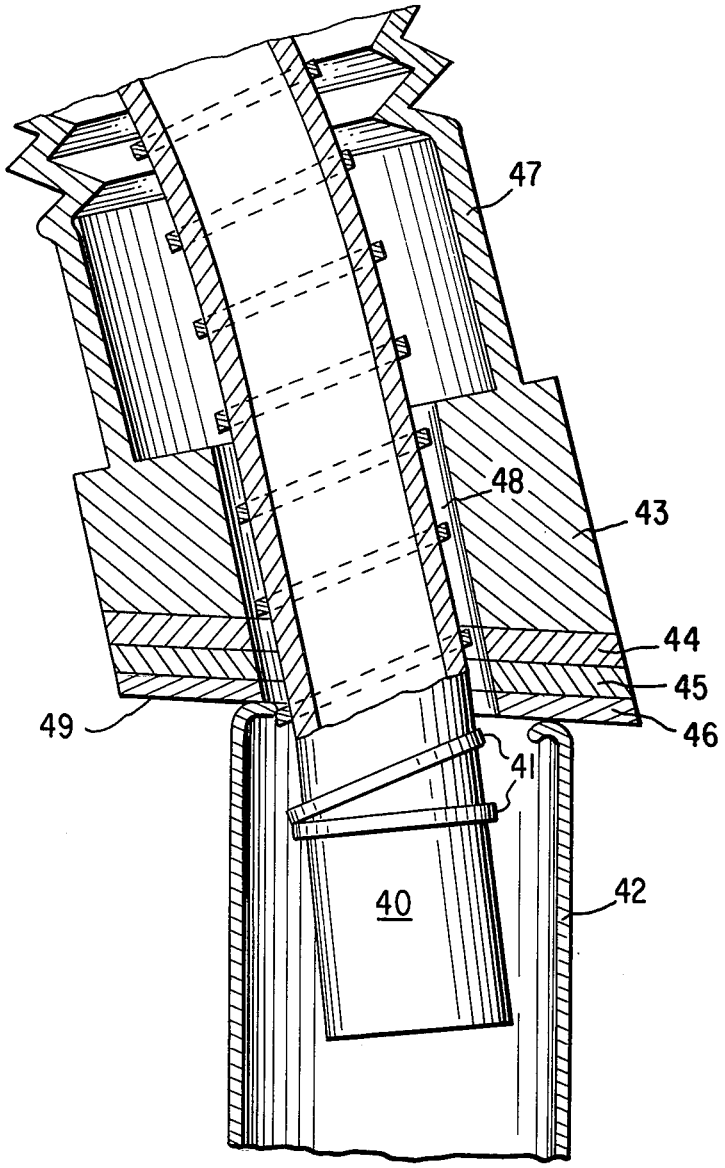
FIG. 3 is an enlarged view, partly in cross-section of the nozzle assembly of the invention inserted into an automobile fillpipe.

Referring to FIG. 3, the most preferred vapor recovery means is shown. The main portion of the fuel-dispensing nozzle is not shown in FIG. 3, but the majority of the spout of the nozzle is shown therein. Referring more specifically to FIG. 3, a spout 40 is encircled for the majority of its length by a spring means 41, which preferably has a square cross-sectional area, although it is within the scope of the present invention to employ a round spring means. The spout is shown as being surrounded by a flexible bellows 47 which terminates in a heel portion 43. Attached to the front face of heel portion 43 is a metal plate 44 which bears upon its outer face a unidirectional magnet 45. To the front face of the unidirectional magnet is applied a thin piece of a resilient material 46 which is relatively softer than the magnet, such as leather, foam or other suitable plastic material for providing an improved seal between the upper portion of the fillpipe 42 and the unidirectional magnet 45. The metal plate, unidirectional magnet and resilient material 46 may be bonded together by any suitable means, such as by the use of an epoxy cement or such other similar adhesive. The spout is shown in FIG. 3 as being inserted into a fillpipe 42 such as that of an automobile. As the spout is forced into the fillpipe 42, the bellows 47 is compressed and the surface 49 forms a tight seal with the upper portion of the fillpipe 42, thereby minimizing the escape of hydrocarbon vapors into the atmosphere. It should be noted that the percentage of vapor recovered is appreciably less when the magnetic seal herein described is not utilized. Rather, the escaping vapors from the fillpipe enter space 48 from which they are free to proceed into the interior of bellows 47. A suitable means is then provided, such as the means shown in FIGS. 1 or 2, for removing the vapor from this point for treatment and/or disposal. The spring means 41 also assists in supporting the spout in the fillpipe, and the unidirectional magnet 45 provides additional directional force for supporting the nozzle in the delivery position in the fillpipe.

EXAMPLE I

A modified OPW #7 vapor recovery nozzle was equipped with a polychloroprene bellows boot one end of which was attached to the nozzle housing, the other end surrounding the nozzle outlet having a surface face. The modification of the nozzle was the inclusion of a ¾-inch vapor return line on the bottom of the handle area. A square cross-section retention spring was used on the spout. The bellows boot was substantially the same geometrical configuration as the boot set forth in FIG. I. The surface of the first boot was modified by bonding to the face a closed seal polychloroprene foam of approximately ¼ inch thickness. The surface of the second boot was modified by affixing a unidirectional magnet to the boot surface. The magnet was further modified by the bonding of an outlet leather surface to the magnet.

A third boot was modified the same as the second boot except that a closed cell urethane foam having a thickness of ⅛ inch was affixed to the unidirectional magnet. The leather surface was then affixed to the closed cell urethane foam.

A fourth boot was modified the same as the second boot except silicone rubber was utilized in place of leather.

The above gasoline nozzles were evaluated in a typical service station environment at ambient temperatures. Table I lists the results obtained from the evaluation of these gasoline nozzles.

TABLE I

| Type of Nozzle | No. of Cars Tested | % Hydrocarbon Recovery |
|---|---|---|
| OPW #7 + polychloroprene foam | 40 | 83.7% |
| OPW #7 + magnet + leather | 12 | 92.2% |
| OPW #7 + magnet + urethane foam + leather | 13 | 97.76% |
| OPW #7 + magnet + silicone rubber | 12 | 97.4% |

The above examples demonstrate the outstanding recovery of hydrocarbon vapor using the improved vapor recovery apparatus of this invention. More particularly, the comparative results set forth in Example I demonstrate the contribution of the unidirectional magnet sealing means in substantially preventing the escape of hydrocarbon vapor during the dispensing of fuel to a motor vehicle. The increase in percent recovery is particularly relevant where high hydrocarbon recoveries are required due to environmental regulations.

Thus, the use of a highly anisotropic or mono-directional magnet, preferably backed by a steel plate, is critical to the present invention. In addition to providing an improved seal between the fuel-dispensing nozzle and the fillpipe, thereby minimizing vapor loss to the atmosphere, the unidirectional magnet also assists in supporting the nozzle in the fuel-delivery position while in the fillpipe. This is especially advantageous for unattended operations or, for self-service gasoline stations where an unskilled individual uses a fuel-dispensing nozzle.

The bellows or other similar vapor recovery means which surrounds the spout of the nozzle can be made of any suitable material, and is normally comprised of a synthetic resin material such as neoprene rubber which is flexible enough to permit the bellows to be compressed when the spout is forced into a fillpipe of a fuel tank and which is substantially resistant to the fuel and vapor. The material must, of course, have "memory" so that it will return to its initial position when the spout of the nozzle is removed from the fillpipe. Such bellows means are available commercially and in fact are described in the prior art such as the prior art noted hereinabove.

The improved vapor sealing means of the present invention can be employed with any liquid-dispensing nozzle. Although the system of the present invention has been disclosed with reference to a fuel delivery system, particularly a gasoline delivery system, the nozzle assembly of the present invention can be used to prevent escape of vapors in systems for the delivery of liquids other than fuels. Accordingly, it is seen that in accordance with the present invention a nozzle assembly is provided for the delivery of liquids and including means for substantially preventing escape to the atmosphere of vapor during such delivery.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. A liquid dispensing nozzle assembly for delivery of liquid from a liquid source to a liquid receiver having a receiver inlet and provided with means to allow for the removal of vapor during delivery of liquid to said receiver inlet from said source, said nozzle assembly comprising:

(1) a liquid dispensing nozzle having a nozzle inlet, a nozzle housing and an elongated discharge spout adapted for insertion into said receiver inlet;

(2) a vapor collector surrounding, in spaced relation thereto and forming a chamber therearound, the upper portion of said spout nearest said nozzle housing, said chamber being in fluid communication with the receiver inlet when said spout is inserted into said liquid receiver, one end of said vapor collector being sealed to said nozzle housing or said nozzle discharge spout, a magnet sealant means carried by the other end of said vapor collector and having an exposed face for forming a surface seal against the outer surface of said receiver inlet, said spout extending beyond the other end of said vapor collector; and (3) means for allowing removal of vapor from said nozzle assembly; the improvement comprising said magnet sealant means comprising an anisotropic magnet with an exposed face comprising a resilient material selected from the group consisting of leather, polychloroprene, silicone rubber and a compressible cellular plastic material for contacting the receiver inlet, said anisotropic magnet having (a) a hard continuous medium, and (b) a strong magnetic attraction for ferrous materials in a direction substantially axially with said spout;

said material having (a) compressibility of the material in contact with the outer surface of the receiver inlet to allow the anisotropic magnet to urge said face against said receiver inlet when said spout is inserted into and said face contacts said receiver inlet;

(b) substantial resistance to the liquid dispensed and vapor being removed, and;

(c) the ability to form a seal against the outer surface of said receiver inlet and reduce the amount of vapor escaping to the atmosphere during the liquid dispensing when said spout is inserted into and said exposed face contacts the outer surface of said receiver inlet.

2. A liquid dispensing nozzle assembly of claim 1 wherein said anisotropic magnet is a hard ceramic magnet selected from the group consisting of barium, iron oxide and strontium iron oxide.

3. A liquid dispensing nozzle assembly of claim 2 wherein said vapor collector comprises a flexible vapor collector bellows and the liquid is a fuel.

4. A liquid dispensing nozzle assembly of claim 2 wherein said magnet sealant means has a metal backing plate which significantly increases the magnetic force of the magnet which interposed between said magnet and said vapor collector.

5. A liquid dispensing nozzle assembly of claim 4 wherein said vapor collector comprises a flexible vapor collector bellows and the liquid is a fuel.

6. A liquid dispensing nozzle assembly of claim 4 wherein said metal backing plate and said magnet are substantially of the same axial thickness.

7. A liquid dispensing nozzle assembly of claim 4 wherein said resilient material is a compressible cellular plastic material.

8. A liquid dispensing nozzle assembly of claim 7 wherein said resilient material comprises at least one compressible cellular plastic material obtained from a polymer selected from the group consisting of polychloroprene latex, silicone, urethane polymer, poly (vinyl chloride) and polytetrafluoroethylene, and the liquid is a fuel.

9. A liquid dispensing nozzle assembly of claim 7 wherein the exposed face of the compressible cellular plastic material comprises an additional resilient material.

10. A liquid dispensing nozzle assembly of claim 9 wherein said additional resilient material is selected from the group consisting of leather and a synthetic resinous material.

11. A liquid dispensing nozzle assembly of claim 9 wherein said additional resilient material is selected from leather and polychloroprene.

12. A liquid dispensing nozzle assembly of claim 2 wherein said resilient material is a compressible cellular plastic material.

13. A liquid dispensing nozzle assembly of claim 12 wherein said resilient material comprises at least one compressible cellular plastic material obtained from a polymer selected from the group consisting of polychloroprene latex, silicone, urethane polymer, poly (vinyl chloride) and polytetrafluoroethylene and the liquid is a fuel.

14. A liquid dispensing nozzle assembly of claim 13 wherein the compressible cellular plastic material is obtained from a polymer selected from the group consisting of polychloroprene latex, and polytetrafluoroethylene.

15. A liquid dispensing nozzle assembly of claim 13 wherein the exposed face of the compressible cellular plastic material comprises an additional resilient material.

16. A liquid dispensing nozzle assembly of claim 12 wherein the exposed face of the compressible cellular plastic material comprises an additional resilient material.

17. A liquid dispensing nozzle assembly of claim 16 wherein said additional resilient material is selected from the group consisting of leather and a synthetic resinous material.

18. A liquid dispensing nozzle assembly of claim 16 wherein said additional resilient material is selected from leather and polychloroprene.

* * * * *